US010239678B2

(12) United States Patent
Tang

(10) Patent No.: US 10,239,678 B2
(45) Date of Patent: Mar. 26, 2019

(54) BUFFERING INFLATABLE PACKAGING BAG

(71) Applicant: GREEN PACKAGING TECHNOLOGY (JIANG SU) CO., LTD., Changzhou (CN)

(72) Inventor: Cheng Tang, Kunshan (CN)

(73) Assignee: GREEN PACKAGING TECHNOLOGY (JIANG SU) CO., LTD., Changzhou (CN)

( * ) Notice: Subject to any disclaimer, the term of this patent is extended or adjusted under 35 U.S.C. 154(b) by 0 days.

(21) Appl. No.: 15/653,515

(22) Filed: Jul. 18, 2017

(65) Prior Publication Data

US 2017/0313490 A1 Nov. 2, 2017

Related U.S. Application Data

(63) Continuation of application No. PCT/CN2016/070018, filed on Jan. 4, 2016.

(30) Foreign Application Priority Data

Jan. 23, 2015 (CN) ..... 2015 2 0046442 U

(51) Int. Cl.

| | |
|---|---|
| ***B65D 81/03*** | (2006.01) |
| ***B65D 81/02*** | (2006.01) |
| ***B65D 81/05*** | (2006.01) |
| ***B65D 85/30*** | (2006.01) |
| ***B65B 55/20*** | (2006.01) |
| *B65D 81/00* | (2006.01) |
| *B65D 85/00* | (2006.01) |

(52) U.S. Cl.

CPC ..... *B65D 81/03* (2013.01); *B65B 55/20* (2013.01); *B65D 81/02* (2013.01); *B65D 81/05* (2013.01); *B65D 85/30* (2013.01); *B65D 81/00* (2013.01); *B65D 85/00* (2013.01)

(58) Field of Classification Search

CPC ..... B65D 81/03; B65D 81/052
USPC ..... 206/522
See application file for complete search history.

(56) References Cited

U.S. PATENT DOCUMENTS 7,959,002 B2 * 6/2011 Liao ..... B65D 81/052 206/522

* cited by examiner

*Primary Examiner* — King M Chu
(74) *Attorney, Agent, or Firm* — Syncoda LLC; Feng Ma

(57) ABSTRACT

A buffering inflatable packaging bag includes a containing part and an isolating part that are composed of an inflatable plastic capsule; a containing cavity of containing part is folded by the inflatable plastic capsule along a length direction of a bar-shaped inflatable chamber, and a folded portion is sealed along both sides of the inflatable plastic capsule; a circle of a first thermally sealing line is provided at one end of containing part distal from the opening of containing part; one end of isolating part is provided on one side of the opening of containing part. The packaging has a low cost and simplified processing. One product can package and fix the body and the accessories simultaneously, thereby avoiding the breakage of inner package. The accessories can be placed above the body, thereby avoiding the phenomenon that the intensity of pressure is excessive to cause damage to the body/accessories.

10 Claims, 6 Drawing Sheets

BUFFERING INFLATABLE PACKAGING BAG

CROSS-REFERENCE TO RELATED APPLICATIONS

The present application is a continuation of, and claims priority to, PCT/CN2016/070018 filed on Jan. 4, 2016, which in turn claims priority to Chinese Patent Application No. 201520046442.X, filed Jan. 23, 2015. The disclosures of these applications are hereby incorporated by reference in their entirety.

BACKGROUND

In the transport process, glass, electronic goods, precision instrument and other products are damaged due to external knock and shock. Therefore, it is necessary to wrap a protective material in the outer layer of these products, so as to play a role of anti-knock, anti-moisture, anti-extrusion, anti-shock, anti-friction and so on for the goods. In the prior art, a foamed plastic formed by expanded polystyrene (EPS) and polyethylene foam (EPE) is usually used as a material for wrapping goods. However, due to the larger volume occupied by the foaming plastic after foam forming, the transport cost is increased in use, and the foaming plastic is a typical "white pollution", which is not easy to degrade in the soil after abandoning and also produces a poison gas upon burning. Accordingly, for the purpose of the growing demand for environmental protection, the above foaming plastic is no longer suitable for use as a protective material for goods.

In order to replace the foaming material mentioned above, there is an inflatable packaging bag in recent years, comprised of a plurality of inflatable chambers, each of which is provided with a one-way check valve in an inflatable end. Gas inflation is directed to the inflatable chambers via the valve. The valve is automatically locked after the gas inflation is finished, and the inflatable chambers form a gas column wrapping the outer layer of goods, so as to play a role of buffering the knock and shock generated in the transport process. Such as CN1903675A, the inflatable bag is generally composed of two wide plastic films and two narrow plastic films, wherein the two wide plastic films are placed on the surface layer, the two narrow plastic films are placed on the middle layer, and the two wide plastic films form a body of inflatable bag through thermally-sealing, and the two narrow plastic films are bonded together with the two wide plastic films through thermally-sealing by printing an ink-anti-high temperature on the opposite surface. A portion that is printed the ink may not be sealed thermally so that a one-way check valve is formed to both separately form an intake passage and fittingly form a gas tight effect. The inflatable bag may be used as a cushion or filled between the goods and the packaging box, or packaging the goods, and may also further form a packaging bag which can be directly sheathed outside the goods after gas inflation by different folding and partial thermally-sealing.

With the rapid development of internet technology and electronic commerce, people are increasingly accustomed to enjoy the shopping mode of staying at home and buying all over the world, which also puts forward a higher demand for efficiency and transport volume of the transport service industry. But related personnel training and supporting cannot keep up with time, thereby causing the presence of an inevitable violent transport and other problems in the transport process. The above problem has little impact on clothing and other goods, but has a greater impact on glass, electronic goods and precision instrument and so on.

In order to solve the above problem, the existing method generally uses an inflatable packaging bag as an inner package to completely wrap and then stack the goods and the accessories into an outer package. The notebook computer, for example, the existing method is to use an inflatable packaging bag as an inner package to completely wrap the notebook computer body, the keyboard and the mouse and other important accessories, respectively, and then put the body and the accessories into the outer package (carton). Specific solutions are as follows.

Situation 1: when the accessories are stacked above the body at random, there is a large residual space left above the body in many cases (as shown in FIG. 1). The package of accessories/accessories and body may cause the extrusion and the lateral relative displacement upon carrying, sometimes the package is extruded broken and the surface of goods leaves scratches in the subsequent transport process, even affecting the product function and other adverse conditions.

Situation 2: the accessories and the body are placed laterally at the same time, in this case, the length of outer package (usually as box type) is required to be very long. In terms of the outer package of same volume, the shape undoubtedly need consume more materials. In addition, the cross-section is small due to the lateral placement of accessories and body, and the intensity of pressure on the accessories and the body may be greater upon subjecting to the shock in the length direction, more easily causing damage to the body/accessories.

Situation 3: in order to prevent the occurrence of adverse condition in 1, another method lies in that the interior of the outer package (usually as a box or a carton) is set as well sized grids with a hard material (cardboard or steel plate), and then the inflatable packaging bag as the inner package completely wraps the body and the accessories and then is put into corresponding grip, so as to avoid the mutual friction between the accessories and the body, thereby mitigating the adverse condition in 1. However, this method can also have defect. First, in order to ensure the stability of the grid, the choice of material must be cardboard or steel plate or plastic plate and other hard materials. Although the hard material grid avoids the mutual friction between the body and the accessories, the shape and size of grip cannot completely fit with the shape and size of accessories/body. Thus, the accessory/body may have a small portion of activity space within the grid. Due to process and other problems, there may be burr on the hard material, particularly to the steel plate. The burr also easily punctures the inner package (the inflatable packaging bag) of the accessory/body when the accessory/body actives, thereby enabling the failure of anti-knock and anti-shock of the inner package. In addition, the extra hard material grid increases the package cost, and results in a great deal of material waste due to disposable packaging.

SUMMARY

In view of the defects existed in the prior art, the present disclosure provides a buffering inflatable packaging bag provided with an isolating zone. The packaging bag can avoid the activity of the accessories and body in the package in the case of using as little packaging material as possible, thereby better protecting the packaged.

Various embodiments of the present disclosure can be achieved by the following technical approaches.

A buffering inflatable packaging bag comprises a containing part and an isolating part that are composed of an inflatable plastic capsule; the inflatable plastic capsule has a plurality of bar-shaped inflatable chambers, each of which communicates with an overall passage of gas inflation via a one-way check valve; the containing part is provided with a containing cavity; the containing cavity is folded by the inflatable plastic capsule along a length direction of the bar-shaped inflatable chamber, and the folded portion formed by folding is sealed along a first sealing line provided on both sides of the inflatable plastic capsule; an opening of the containing cavity is an opening of the containing part; a circle of a first thermally sealing line is provided at one end of the containing part far from the opening of the containing part; one end of the isolating part is provided on one side of the opening of the containing part.

In the above buffering inflatable packaging bag, a second thermally sealing line is provided at a joint of the isolating part and the containing part along a width direction of the bar-shaped inflatable chamber; the first thermally sealing line and the second thermally sealing line comprise a short thermally sealing line that lies on each of the bar-shaped inflatable chambers in the middle of the inflatable plastic capsule and is less than the width of the bar-shaped inflatable chamber in length.

In the above buffering inflatable packaging bag, the isolating part and the containing part are composed of a same sheet of inflatable plastic capsule; the overall passage of gas inflation of the inflatable plastic capsule is provided at the containing part; the second thermally sealing line further comprises a long thermally sealing line that lies on the bar-shaped inflatable chamber near an edge and is not less than the width of the bar-shaped inflatable chamber in length.

In the above buffering inflatable packaging bag, the first sealing line is provided at a free side of the bar-shaped inflatable chamber at the edge or between the two adjacent bar-shaped inflatable chambers.

In the above buffering inflatable packaging bag, the isolating part is a double-layer structure formed by folding the inflatable plastic capsule along the length direction of the bar-shaped inflatable chamber; a circle of a third thermally sealing line is provided at one end of the double-layer structure far from the opening of the containing part; the third thermally sealing line comprises a short thermally sealing line that lies on each of the bar-shaped inflatable chambers in the middle of the inflatable plastic capsule and is less than the width of the bar-shaped inflatable chamber in length.

In the above buffering inflatable packaging bag, both sides of the double-layer structure are sealed by the second sealing line provided on both sides of the inflatable plastic capsule.

In the above buffering inflatable packaging bag, the second sealing line is provided at the free side of the bar-shaped inflatable chamber at the edge or between the two adjacent bar-shaped inflatable chambers.

In the above buffering inflatable packaging bag, the first sealing line and corresponding second sealing line are in a same plane.

In the above buffering inflatable packaging bag, the double-layer structure has only one layer connected with the opening of the containing part on one side; the length between two layers of the double-layer structure is different.

In the above buffering inflatable packaging bag, the length of one layer on the double-layer structure connected with the containing part is shorter than another layer of the double-layer structure.

The beneficial effects of various embodiments of the present disclosure can include one or more of the following:

1. the function of fixing the packaged and the function of anti-shock are achieved by only using the inflatable packaging bag, without additionally providing grids on the outer package (carton or box), thereby reducing cost, saving material;

2. one product according to some embodiments can complete the task that packages and fixes the body and the accessories at the same time, and no relative displacement occurs between the body and the accessories in the transport process, thereby avoiding the scratch of the packaged resulted from the inner package breakage;

3. when the packaging bag according to some embodiments disclosed herein is used, the accessories are placed above the body, without the lateral placement of the accessories and the body, and when the packaging bag is subjected to the shock in the length direction, the intensity of pressure is excessive, thereby causing damage to the body/accessories.

Figure 1:
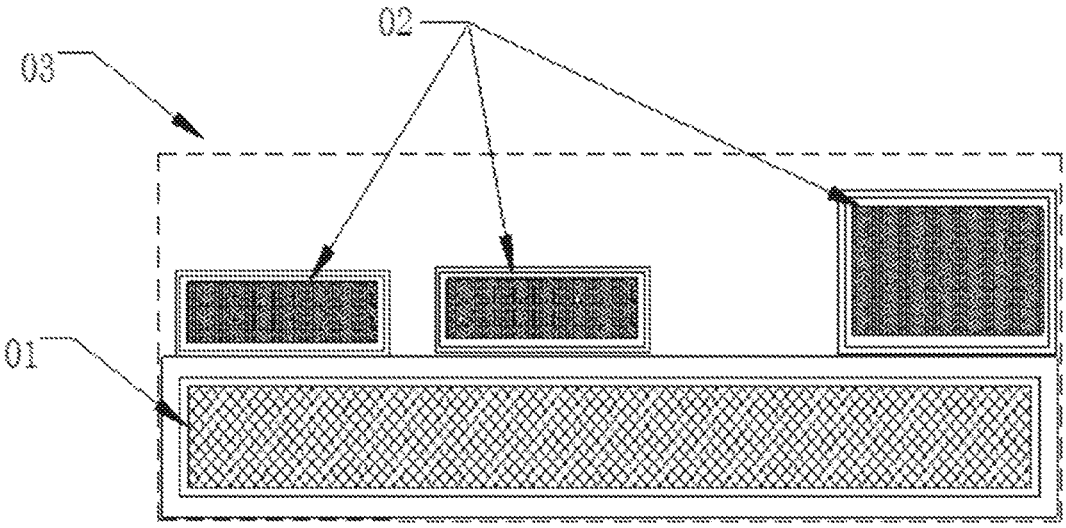
FIG. 1 (PRIOR ART)
FIG. 1 is a schematic diagram of the section of a packaging method in the prior art.

In the drawings, 01: body; 02: accessories; 03: outer package; 1: wide plastic film; 2: wide plastic film; 3: narrow plastic film; 4: narrow plastic film; 5: bar-shaped inflatable chamber; 6: overall passage of gas inflation; 10: one-way check valve; 11: containing cavity; 12: double-layer structure; 801: first sealing line; 802: second sealing line; 901: first thermally sealing line; 902: second thermally sealing line; 903: third thermally sealing line; 9021: long thermally sealing line.

DETAILED DESCRIPTION

In order to make those skilled in the art better understand the solution of the various embodiments, the embodiments are further illustrated in detail in combination with the drawings and the detailed description.

FIG. 1 presents an existing packaging method employed in the situation 1 of background art, in which a body 01 and accessories 02 are wrapped, respectively, and are stacked in an outer package 03 (usually as a box), and the accessories 02 are placed on the body 01. The accessories 02 and the body 01 may cause an extrusion and a lateral relative displacement upon carrying, even sometimes the inner package wrapping the accessories 02 or the body 01 is extruded broken, and the surface of goods may leave scratches in the subsequent transport process due to the relative displacement.

Figure 2:
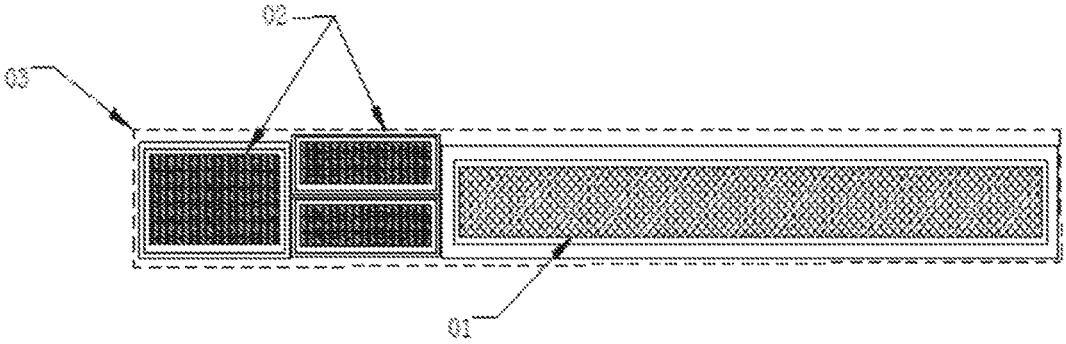
FIG. 2 (PRIOR ART)
FIG. 2 is a schematic diagram of the section of a second packaging method in the prior art.

FIG. 2 presents an existing packaging method employed in the situation 2 of background art, in which a body 01 and accessories 02 are wrapped, respectively, and are stacked in an outer package 03 (usually as a box), and the accessories 02 and the body 01 are placed laterally in side-by-side within the outer package 03. In this case, the length of the outer package 03 (usually as box type) is required to be very long. In terms of the outer package 03 of same volume, the shape undoubtedly need consume more materials than the box type package with approximate long, wide and high. In addition, due to the cross-section the outer package 03 being small, the intensity of pressure on the accessories 02 and the body 01 may be greater upon subjecting to the shock in the length direction, more easily causing damage to the body 01/accessories 02.

The solution of adding the hard material to divide the interior of the outer package 03 into well sized grids is described in the situation 3 of background art, not repeating here.

Some embodiments provide a buffering inflatable packaging bag, comprising a containing part and an isolating part that are composed of an inflatable plastic capsule.

Figure 3:
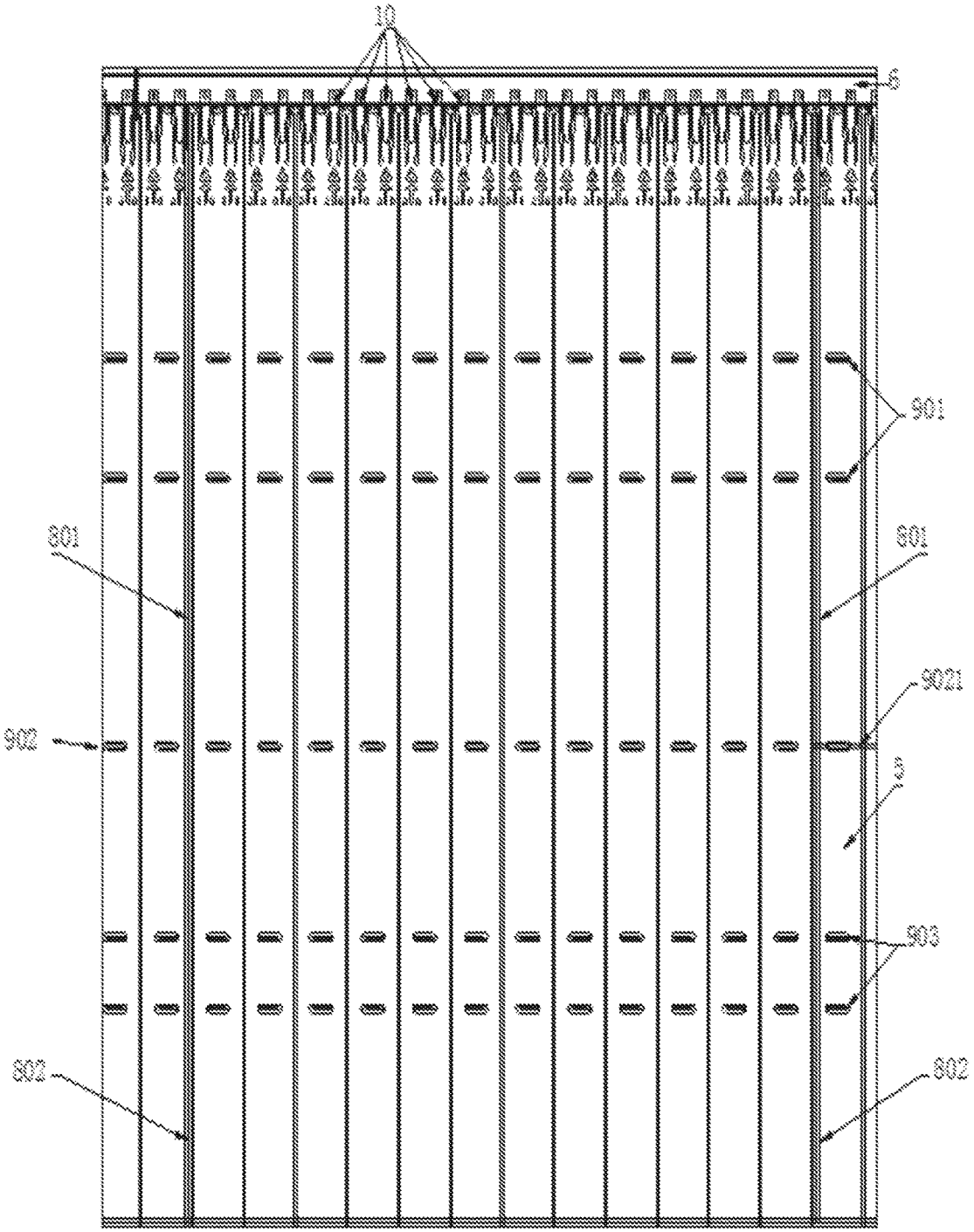
FIG. 3 is a schematic diagram of a buffering inflatable packaging bag in an unfolded state according to some embodiments.
Figure 8:
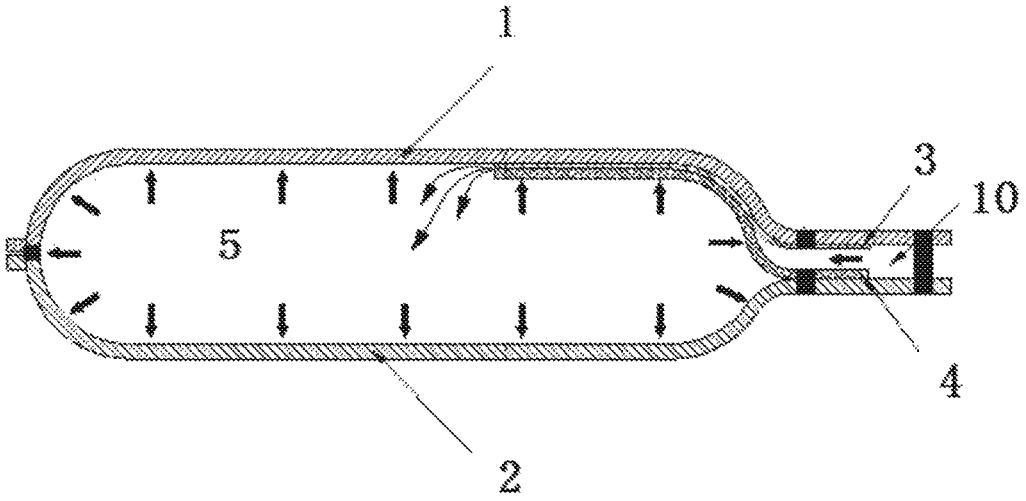
FIG. 8 is a schematic diagram of interior of the inflatable plastic capsule.

In order to facilitate to understand the structure of the inflatable plastic capsule, those skilled in the art can refer to the schematic diagrams of the inflatable plastic capsule being unfolded shown in FIG. 3 and in an inflatable state shown in FIG. 8. The inflatable plastic capsule is a structure having a plurality of bar-shaped inflatable chambers 5 formed by a thermally-sealing upon two wide plastic films 1, 2 placed on a surface layer and two narrow plastic films 3, 4 placed on a middle layer, and a self-absorption one-way check valve 10 formed by each of bar-shaped inflatable chambers 5 through the two narrow plastic films 3, 4 communicates with a flute-shaped overall passage of gas inflation 6. In the two narrow plastic films 3, 4, a thickness of a sheet of narrow plastic film constituting a blocked layer of the inner space is 100%-135% of a thickness of another sheet of narrow plastic film constituting a blocked layer of the outer space. The blocked layer is thickened so that the gas tightness of the one-way check valve 10 is better. Upon the gas inflation, the gas enters each of the bar-shaped inflatable chambers 5 via the one-way check valve 10 through which the hole of the overall passage of gas inflation 6 passes, respectively. After the gas inflation, due to the presence of the one-way check valve 10, the gas within the bar-shaped inflatable chambers 5 cannot be returned to the overall passage of gas inflation 6, so as to ensure that the bar-shaped inflatable chambers 5 are filled with gas and have gas tightness.

The buffering inflatable packaging bag according to some embodiments comprises a containing part and an isolating part. In order to better understand the embodiments, those skilled in the art can refer to FIGS. 3, 4, 5, and 6.

Figure 5:
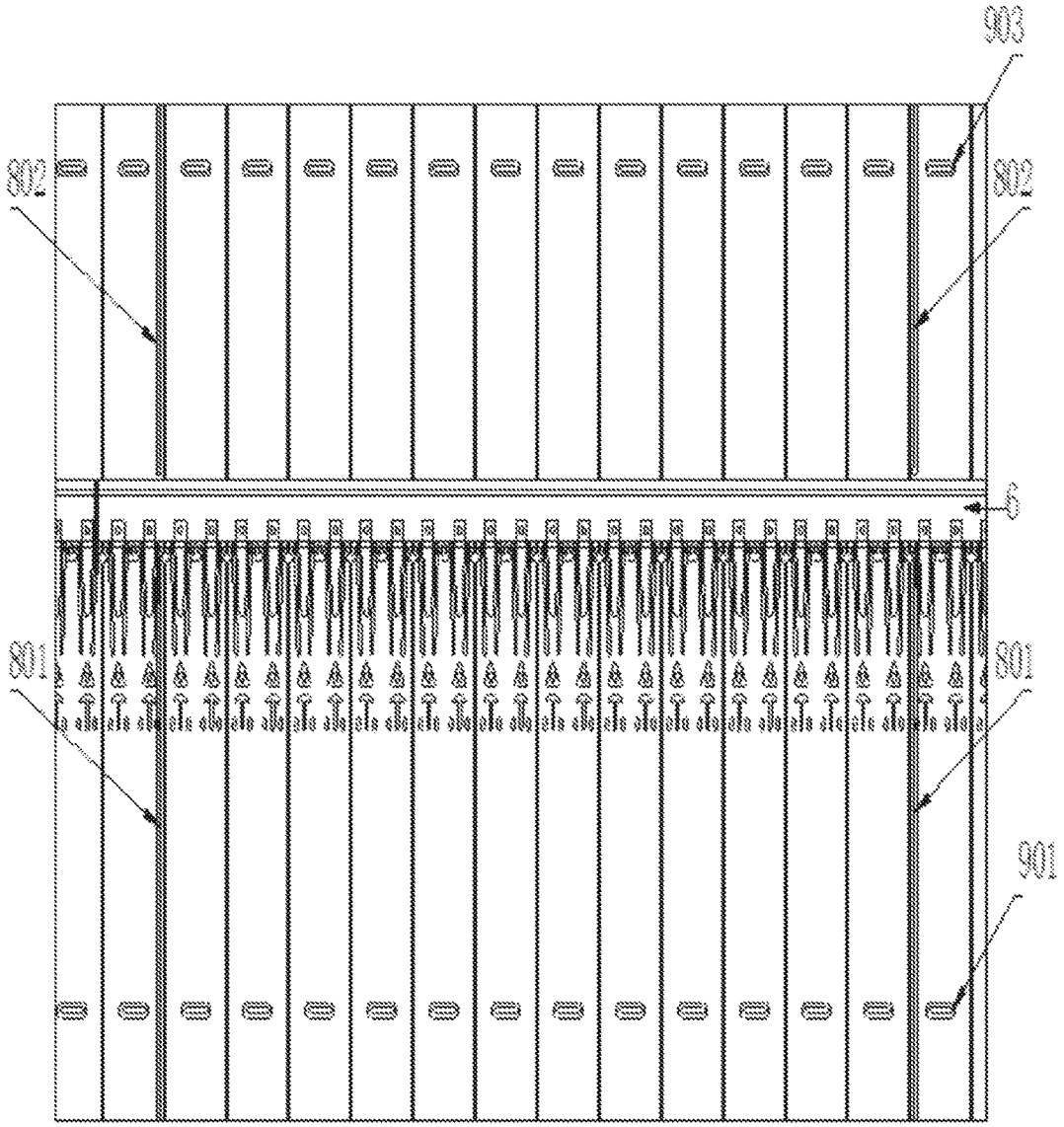
FIG. 5 is a schematic diagram of another side of the folded state shown in FIG. 4.
Figure 6:
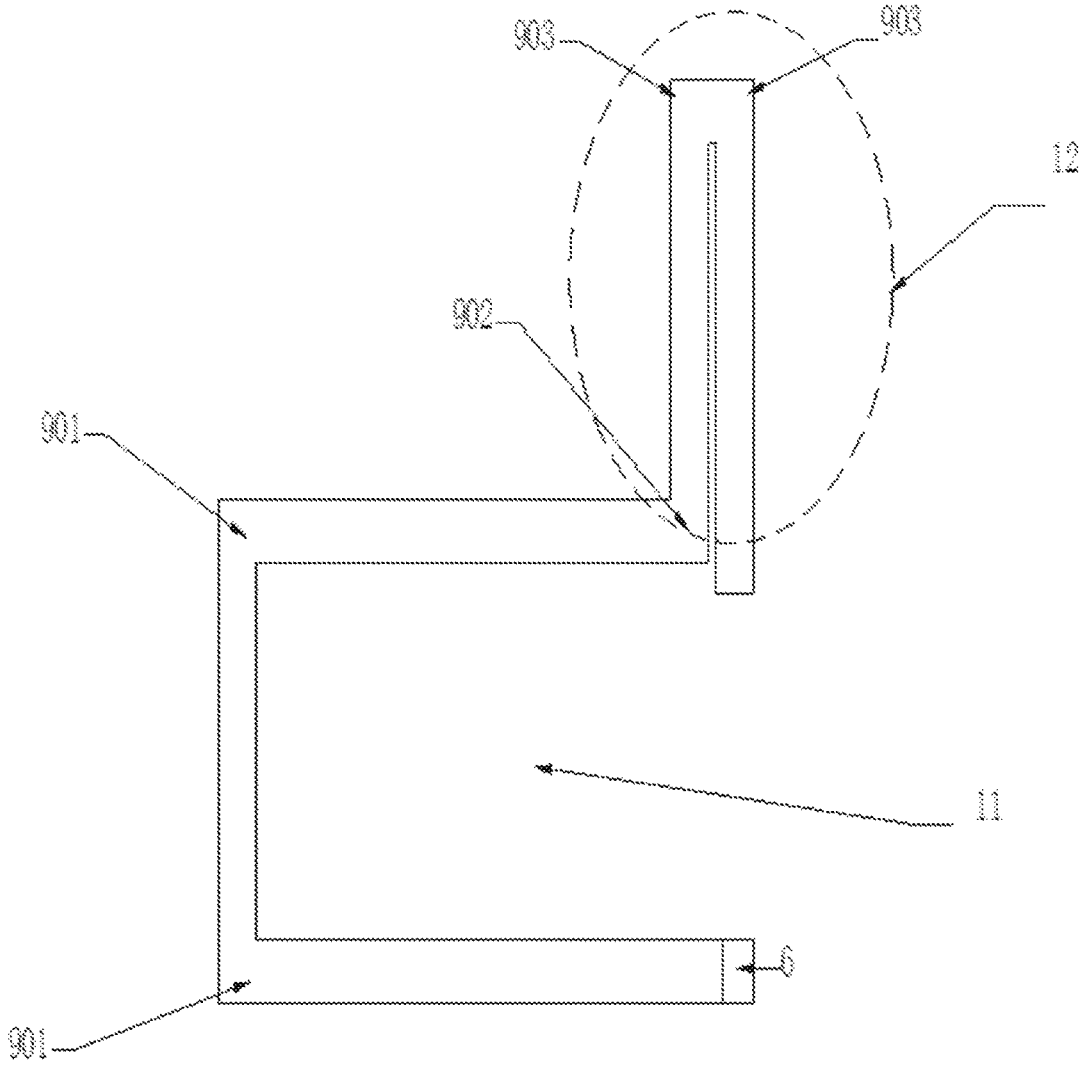
FIG. 6 is a schematic diagram of the section of a buffering inflatable packaging bag after gas inflation according to some embodiments.

The containing part is provided with a containing cavity 11 labeled in FIG. 6. The inflatable plastic capsule shown in FIG. 3 is folded along a centerline parallel to two first thermally sealing lines 901, and one side of the folded portion formed by folding is shown in the lower half portion of FIG. 5, another side is shown in the upper half portion of FIG. 4. The folded portion is sealed along a first sealing line 801. Two first thermally sealing lines 901 just form as a same thermally sealing line, and the folded portion forms a bagged structure, the interior of which is the containing cavity 11 (in order to facilitate the understanding, referring to a schematic diagram of an inflatable state in FIG. 6). Upon the gas inflation, the bar-shaped inflatable chambers 5 open as the gas enters. The portion between the two first thermally sealing lines 901 on the bar-shaped inflatable chambers 5 forms a bottom portion of the containing cavity 11. A portion of bar-shaped inflatable chambers 5 on the folded portion forms a front wall and a rear wall of the containing cavity 11, and a portion of bar-shaped inflatable chambers 5 near the sealing line 801 on the folded portion forms two side walls of the containing cavity 11 in the drag of the bottom portion of the containing cavity 11.

Figure 4:
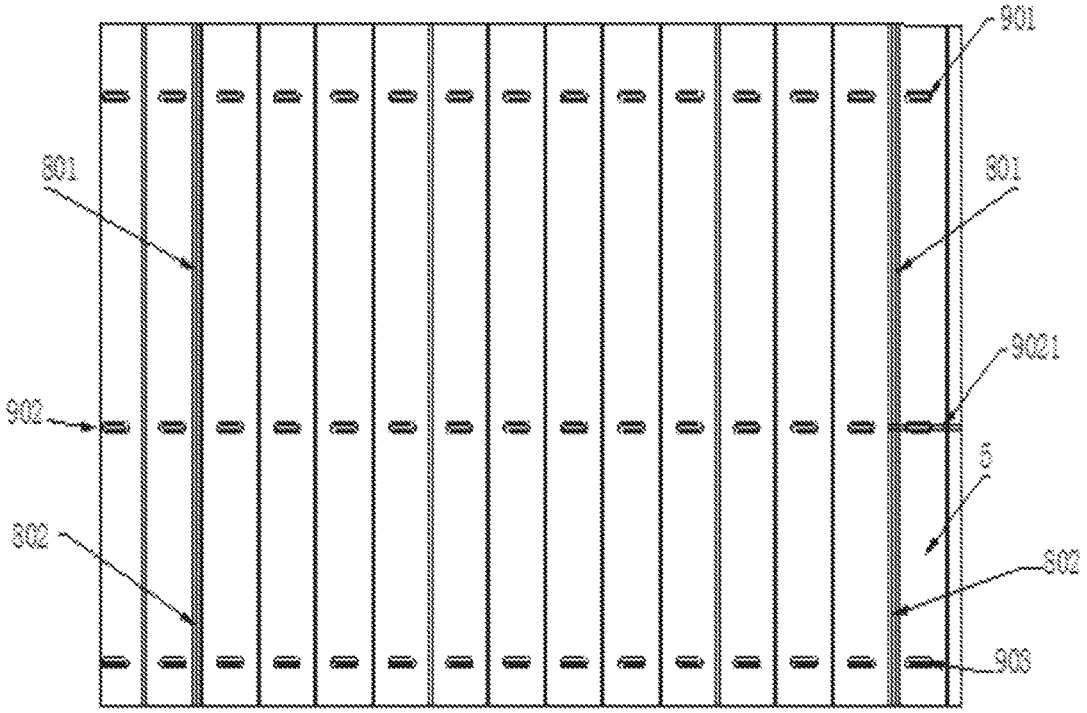
FIG. 4 is a schematic diagram of a buffering inflatable packaging bag in a folded state according to some embodiments.
Figure 7:
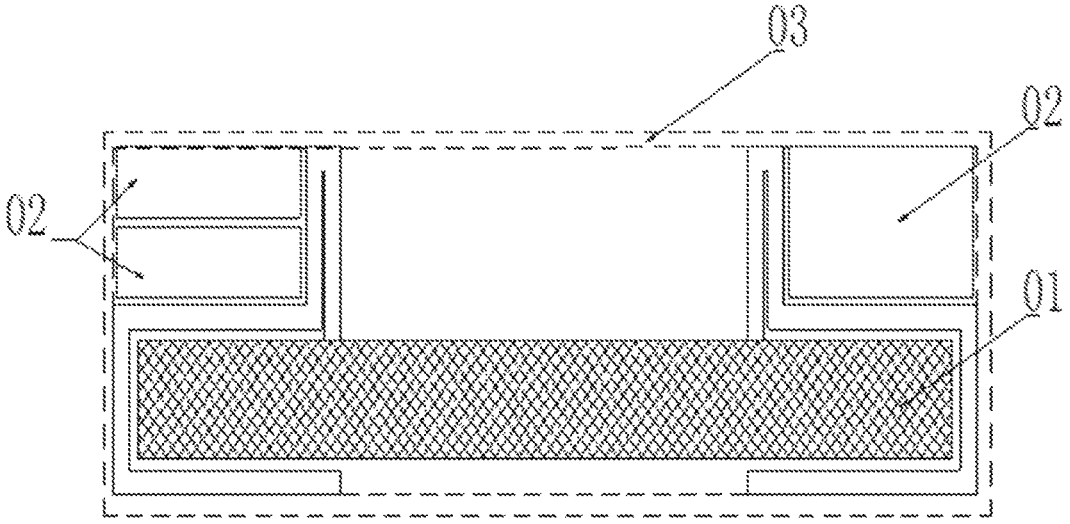
FIG. 7 is a schematic diagram of the section of a buffering inflatable packaging bag in one use state according to some embodiments.

In the present embodiment, another end of the inflatable plastic capsule constituting the containing part is folded along a centerline parallel to two third thermally sealing lines 903, and one side of the folded portion formed by folding is shown in the upper half portion of FIG. 5, another side is shown in the lower half portion of FIG. 4. The folded portion formed by folding forms a double-layer structure 12 after being sealed by a sealing line 802 (in order to facilitate the understanding, referring to a schematic diagram of the section in an inflatable state in FIG. 6). In the present embodiment, the first sealing line 801 and corresponding second sealing line 802 are in a same plane. As such, prior to the folding (referring to FIG. 3), the first sealing line 801 and corresponding second sealing line 802 are in a same line. Accordingly, whether the first sealing line 801 and corresponding second sealing line 802 are processed as the same sealing line or not, the sealing operation can be completed only by one procedure upon the production. No additional sealing steps are required, and no additional adjustment of the equipment is required, thereby reducing the time cost of production and improving the production efficiency. The length between two layers of the double-layer structure 12 is different so as to accommodate different articles into the containing cavity 11 to reveal the shape of the opening of the containing cavity. In the present embodiment, a length of a layer on the double-layer structure 12 connected with the containing part is shorter than another layer of the double-layer structure, so as to accommodate the overall shape of a body 01. As shown in FIG. 7, the package body 01 inflates later, and a layer on the double-layer structure 12 not connected with the containing part is supported on the upper surface of the body 01, so as to support the layer on the double-layer structure 12 connected with the containing part. After the gas inflation, the double-layer structure has a certain strength, and not only can mitigate the shock as an air cushion and play a role of anti-knock and anti-shock, but also can resist the shearing force produced by the shock and play a role of fixing article. As show in FIG. 7, in the transport process, the accessories 02 are fixed on corresponding portion of the outer package 03 by the double-layer structure 12. Even if there is still enough space between two double-layer structures 12 in FIG. 7, the double-layer structure 12 can resist the shearing force produced by the shock, so as to ensure the accessories 02 securely located in the corresponding space. In the present embodiment, a layer of the double-layer structure 12 connected with the containing part is shorter, and has a role of buffering and providing isolating strength. The longer layer can withstand the surface of the contained article in use (as shown in FIG. 7), provide support for the shorter layer, thereby increasingly enhancing the physical strength of the double-layer structure 12.

As shown in FIGS. 3, 4, and 6, a second thermally sealing line 902 is provided at a joint of the isolating part and the containing part along the width direction of the bar-shaped inflatable chamber 5. The first thermally sealing line 901, the second thermally sealing line 902 and the third thermally sealing line 903 comprise a short thermally sealing line that lies on each of the bar-shaped inflatable chambers 5 in the middle of the inflatable plastic capsule and is less than the width of the bar-shaped inflatable chamber in length. As such, on the one hand, the gas can be ensured to enter the overall inflatable chamber 5 from the gas inlet (one-way check valve 10), and on the other hand, the gap between the short thermally sealing line and the inflatable chamber 5 can function as balancing the air pressure.

In some embodiments, because the containing cavity requires to carry articles, the distance between the two first thermally sealing lines 901 is greater than the distance between the two third thermally sealing lines 903. Upon the gas inflation, a portion of the bar-shaped inflatable chambers 5 in the containing part may constitute the side wall of the containing cavity. Therefore, both sides of the isolating part are more than the containing part by a portion of the bar-shaped inflatable chambers 5. This will not only beautiful, but also occupy extra space. In order to solve the problem, the overall passage of gas inflation 6 of the inflatable plastic capsule is provided at the containing part. The second thermally sealing line 902 further comprises a long thermally sealing line 9021 that lies on the bar-shaped inflatable chambers 5 near an edge and is not less than the width of the bar-shaped inflatable chamber 5 in length (the above feature are illustrated in FIGS. 3, 4, 5, and 6). In doing this, a portion of the bar-shaped inflatable chamber 5 provided with the long thermally sealing line 9021 far from the overall passage of gas inflation 6 is not sufficiently inflated, thereby balancing the number of the bar-shaped inflatable chambers 5 of the containing part and the isolating part after the gas inflation. The bar-shaped inflatable chamber 5 that is not inflated on the isolating part cannot occupy extra space, both for the aesthetically pleasing and convenience. The more important point is that the rectangular plastic film with regular shape is needed only in the production, without the need for stitching or cutting, thereby avoiding complicated operation in the subsequent thermally sealing process and sealing process and greatly reducing the time cost and labor cost.

The first sealing line 801 is provided at a free side of the bar-shaped inflatable chamber 5 at the edge or between the two adjacent bar-shaped inflatable chambers 5. The second sealing line 802 is provided at the free side of the bar-shaped inflatable chamber 5 at the edge or between the two adjacent bar-shaped inflatable chambers 5. According to FIGS. 3, 4, and 5, one of the first sealing lines 801 and corresponding second sealing line 802 are located between the second line and the third line left from the bar-shaped inflatable chamber 5, and another of the first sealing lines 801 and corresponding second sealing line 802 are located between the first line and the second line right from the bar-shaped inflatable chamber 5. Upon this setting, there are additional bar-shaped inflatable chambers 5 filled with gas in use. The bar-shaped inflatable chamber 5 functions as a handle so as to facilitate the putting in and taking out of articles, and can provide a secondary buffering function to further enhance the anti-shock performance, and avoid the side wall of the containing cavity 11 contacting the outer package, prevent the side wall from being punctured by burrs inside the outer package.

In the following, packaging a tablet computer will be used as an example to illustrate the use process of some embodiments. The buffering inflatable packaging bag in some embodiments being unused is illustrated in FIGS. 4 and 5. In use, both ends of the tablet computer (i.e., the body 01 shown in FIG. 7) are sheathed into the containing chamber 11 of two buffering inflatable packaging bags, respectively. Then, the buffering inflatable packaging bag is inflated. As the inflatable chamber 5 is inflated, the containing cavity 11 becomes full and tightly wraps the tablet computer, and the double-layer structure 12 is also gradually erected, and has a certain physical strength. Finally, the mouse, the keyboard and other accessories (i.e., the accessories 02 shown in FIG. 7) and the tablet computer wrapped by the buffering inflatable packaging bag are put into the outer package 03 according to spatial arrangement, and then the outer package 03 is sealed (the inner structure of outer package 03 after packaging is as shown in FIG. 7).

In conclusion, some embodiments disclosed herein can have the advantages of processing materials with regular shape and processing technology being simple and efficient. The function of fixing the packaged and the function of anti-shock are achieved by only using the inflatable packaging bag, without additionally providing grids on the outer package (carton or box), thereby reducing cost, saving material. One product can package and fix the body and the accessories at the same time, and no relative displacement occurs between the body and the accessories in the transport process, thereby avoiding the breakage of the inner package. The accessories can be placed above the body, thereby avoiding the phenomenon that the intensity of pressure is excessive to cause damage to the body/accessories.

In the above, a buffering inflatable packaging bag provided by the disclosure is described in detail. In herein, a specific example is used to explain the principle and the implementation of the various embodiments, and the illustration of the above embodiment is only used for helping to understand the disclosure. It should be pointed out that several improvements and modifications are also made to the embodiments disclosed herein for those skilled in the art without departing the principle of the disclosure. These improvements and modifications also fall within the scope claimed by the present disclosure.

The invention claimed is:

1. A buffering inflatable packaging bag, comprising:

an inflatable plastic capsule;

wherein:

the inflatable plastic capsule has a plurality of elongated inflatable chambers, each of which communicates with an overall passage of gas inflation via a one-way check valve;

a containing cavity formed by folding the inflatable plastic capsule along a length direction of the elongated inflatable chamber, and a folded portion formed by said folding is sealed along a first sealing line provided on both sides of the inflatable plastic capsule;

a first thermally sealing line is provided at one end of the containing cavity distal from an opening of the containing cavity and surrounding the containing cavity; and a double-layer structure is provided on one side of the opening of the containing cavity.

2. The buffering inflatable packaging bag of claim 1, further comprising a second thermally sealing line provided at a joint of the double-layer structure and the containing cavity along a width direction of the elongated inflatable chamber; the first thermally sealing line and the second thermally sealing line comprise a short thermally sealing line that lies on each of the elongated inflatable chambers in a middle of the inflatable plastic capsule and has a length less than the width of the elongated inflatable chamber.

3. The buffering inflatable packaging bag of claim 2, wherein the double-layer structure and the containing cavity are composed of a same sheet of inflatable plastic capsule; the overall passage of gas inflation of the inflatable plastic capsule is provided at the containing cavity; the second thermally sealing line further comprises a long thermally sealing line that lies on the elongated inflatable chamber at an edge and has a length not less than the width of the elongated inflatable chamber.

4. The buffering inflatable packaging bag of claim 1, wherein the first sealing line is provided at a free side of the elongated inflatable chamber at an edge or between two adjacent elongated inflatable chambers.

5. The buffering inflatable packaging bag of claim 1, wherein the double-layer structure is formed by folding the inflatable plastic capsule along the length direction of the elongated inflatable chamber; one end of the double-layer structure is provided at one side of the opening of the containing cavity; a third thermally sealing line is provided at one end of the double-layer structure distal from the opening of the containing cavity; the third thermally sealing line comprises a short thermally sealing line that lies on each of the elongated inflatable chambers in a middle of the inflatable plastic capsule and has a length less than the width of the elongated inflatable chamber.

6. The buffering inflatable packaging bag of claim 5, wherein both sides of the double-layer structure are sealed by a second sealing line provided on both sides of the inflatable plastic capsule.

7. The buffering inflatable packaging bag of claim 6, wherein the second sealing line is provided at a free side of the elongated inflatable chamber at an edge or between the two adjacent elongated inflatable chambers.

8. The buffering inflatable packaging bag of claim 6, wherein the first sealing line and corresponding the second sealing line are in a same plane.

9. The buffering inflatable packaging bag of claim 5, wherein the double-layer structure has only one layer connected with the opening of the containing cavity on one side; and lengths of two layers of the double-layer structure are different.

10. The buffering inflatable packaging bag of claim 9, wherein length of one layer of the double-layer structure proximal to the containing cavity is shorter than another layer of the double-layer structure.

* * * * *